US005411208A

United States Patent [19]

Burgener

[11] Patent Number: 5,411,208

[45] Date of Patent: May 2, 1995

[54] PARALLEL PATH INDUCTION PNEUMATIC NEBULIZER

[76] Inventor: John A. Burgener, 944 Meadow Wood Rd., Mississauga, Ontario L5J 2S6, Canada

[21] Appl. No.: 187,556

[22] Filed: Jan. 28, 1994

[51] Int. Cl.[6] ..... B05B 7/24

[52] U.S. Cl. ..... 239/8; 239/314; 239/346; 239/418; 261/78.2

[58] Field of Search ..... 239/8, 314, 338, 340, 239/346, 418, DIG. 7; 261/78.2; 128/200.14, 200.21

[56] References Cited

U.S. PATENT DOCUMENTS

| | | | |
|---|---|---|---|
| 3,084,874 | 4/1963 | Jones et al. | 239/8 |
| 3,421,692 | 1/1969 | Babington et al. | 239/8 |
| 3,421,699 | 1/1969 | Babington et al. | 239/337 |
| 3,425,058 | 1/1969 | Babington et al. | 239/124 |
| 3,864,326 | 2/1975 | Babington | 261/142 |
| 4,206,160 | 6/1980 | Suddendorf et al. | 261/78.2 |
| 4,284,239 | 8/1981 | Ikeuchi | 239/8 |
| 4,344,574 | 8/1982 | Meddings et al. | 128/200.18 X |
| 4,619,845 | 10/1986 | Ayers et al. | 239/8 X |
| 4,880,164 | 11/1989 | Noordermeer | 239/423 |
| 5,213,266 | 5/1993 | Lankinen | 239/338 |

FOREIGN PATENT DOCUMENTS

| | | |
|---|---|---|
| 1986 | 1/1873 | Canada . |
| 2405 | 5/1873 | Canada . |
| 854061 | 10/1970 | Canada . |
| 1013794 | 7/1977 | Canada . |
| 1014194 | 7/1977 | Canada . |
| 2044712 | 6/1991 | Canada . |

*Primary Examiner*—Andres Kashnikow
*Assistant Examiner*—Lesley D. Morris

[57] ABSTRACT

A method and apparatus are provided for atomizing liquids into a gaseous medium, in a fine, highly consistent, uniform dispersion. This pneumatic nebulizer method is designed to allow a wide range of liquids to be atomized without plugging. The process atomizes liquids directly from the surface of a body of liquid, allowing non-wetting materials to be used for the nebulizer. The liquid path does not require a narrowing of diameter at the exit area, nor along the length of the system, which minimizes plugging. The gas orifice is on or near the edge of the liquid path and may be very much smaller than the liquid path's area. The nebulizer has no suction. The liquid flow is controlled by pumping the liquid to the nebulizer. Most pneumatic nebulizer systems rely on the gas flow surrounding the liquid path, the liquid path surrounding the gas flow, or the gas flow being at right angles to the liquid flow. This nebulization process has the gas and liquid flow independently brought together, commonly alongside each other.

20 Claims, 3 Drawing Sheets

PARALLEL PATH INDUCTION PNEUMATIC NEBULIZER

FIELD OF THE INVENTION

This invention relates to a method and apparatus for dispersing liquids into a gas, in a fine, highly consistent, uniform dispersion.

BACKGROUND OF THE INVENTION

Nebulization is extensively used in industry for many purposes such as paint spray systems and fuel burners. Humidifiers often use nebulization to increase the humidity in the air. Some types of analytical equipment use nebulizers to inject liquid samples into the measuring apparatus or heat source. This pneumatic nebulizer method was developed to enhance nebulizers for analytical equipment, but the method is applicable to any of the other uses of nebulizers. Analytical nebulizers require very precise, consistent, fine atomization. However, most present nebulizers have design methods which lead to plugging or salting with prolonged operation.

Pneumatic nebulizers all use the same essential principle (induction) to atomize the liquid: When gas at a higher pressure exits from a small hole (the orifice) into gas at a lower pressure, a gas jet is formed into the lower pressure zone, and the lower pressure gas is pushed away from the orifice. This creates a current in the lower pressure gas zone, and draws some of the lower pressure gas into the higher pressure gas jet. At the orifice, the draw of the lower pressure gas creates considerable suction, the extent depending on the differential pressures, the size of the orifice, and the shape of the orifice and surrounding apparatus. In all pneumatic nebulizers, the suction near the orifice is utilized to draw the liquid into the gas jet. The liquid is broken into small droplets in the process.

Present pneumatic nebulizer designs fit into four categories: 1. Concentric: Liquid flow surrounded by a gas flow or gas flow surrounded by a liquid flow; 2. Cross Flow: Gas flow at right angles to the Liquid flow; 3. Entrained: Gas and liquid mixed in the system and emitted as a combined flow; and 4. Babington types: Liquid is spread over a surface to decrease the surface tension, and passed over a gas orifice.

There are other non-pneumatic ways to atomize liquids, such as Ultra Sonic systems, and high pressure liquid injection, but they do not relate to the pneumatic nebulizer designs discussed in the present application.

1. Concentric Nebulizers

Concentric nebulizers have been in use for a long time. Some of the earliest patents awarded in Canada were for oil burner concentric nebulizers. Canadian Patent # 2405 of Apr. 18, 1873, as illustrated for example in prior art example 1 of FIG. 7A, is for a concentric nebulizer to enhance mixing steam and oil for a better burn in a furnace. The components are made of cast iron, and steel pipes, but the concept remains unchanged in analytical nebulizers such as the Meinhard brand of glass nebulizers sold for analytical equipment today, as illustrated for example in prior art example 2 of FIG. 7B, or the paint spray nozzle of Canadian Patent # 1013794 and 1014194 (1977) by the Black and Decker Company.

The concentric nebulizer works by the gas flow around the liquid orifice causing a suction on the liquid, drawing the liquid into the gas flow, mixing the liquid and gas, and spraying the mixture out in a generally uniform spray. The droplet sizes range considerably depending on the gas speed, volume, liquid viscosity, liquid surface tension, temperature, configuration, and other factors. Concentric nebulizer systems have the liquid and the gas passages narrow at the exit tip, to enhance the suction and to improve the mixing. They vary primarily in the liquid orifice position (either just inside the gas passage, even with the gas passage's end, or just extending past the gas passage) and in the presence of various means of blocking or shaping of the gas flow to enhance the mixing. However, if there are any particles in the liquid, they are most likely to plug the system at the tip since the tip has the smallest diameter. The Black and Decker patents # 1013794 & # 1014194 are primarily oriented towards production of a nozzle that is easy to disassemble and clean, since the common art was to throw nozzles away after each day's usage due to plugging.

Presently, the majority of all pneumatic nebulizer patents for any use are directed to concentric nebulizers.

2. Cross Flow Nebulizers

Cross flow nebulizers also have a long history and are commonly in use. More recent patents have not referred to the cross flow concept, but have rather referred to methods of assembling or providing the gas and liquid more efficiently. U.S. Pat. No. 4,344,574 is an example of a patent on a method for producing a cross flow nebulizer in an efficient and more accurate fashion, as illustrated in prior art example 3 of FIG. 7C. Canadian Patent # 2,044,712 refers to a method of providing atomization with a hand pumped gas source.

The cross flow nebulizer works by the gas flow across the liquid tip causing a suction on the liquid, drawing the liquid into the gas flow, mixing the liquid and gas, and spraying the mixture out in a generally uniform spray. The droplet sizes range considerably depending on the gas speed, volume, liquid viscosity, liquid surface tension, temperature, configuration, and other factors. Again, cross flow nebulizer systems have the liquid and the gas passages narrow at the tip to increase the suction and to improve the mixing. The liquid passage tip must be similar in diameter to the gas passage tip for the suction to be effective. Cross flow nebulizer systems vary primarily in the liquid tip position (either just below the gas passage, or slightly protruding into the gas passage's end). As with the concentric nebulizers, if there are any particles in the liquid, they are most likely to plug the system at the tip since the tip has the smallest diameter.

In general, cross flow nebulizers are neither as stable as the concentric nebulizers, nor as easy to build due to the critical alignment of the gas and liquid passages' tips.

3. Entrained Nebulizers.

For some liquids, nebulization can be improved by having the gas and liquid mix in an inner chamber and then emitted together from a single orifice. This technique has been applied to heavy liquids such as tar, as well as other liquids such as water. Canadian Patent # 1986 of Jan. 16, 1873, is for an entrained system, as illustrated for example in prior art example 4 of FIG. 7D. U.S. Pat. No. 4,284,239 of Aug. 18, 1981, is for an improved nebulizer for water, utilizing turbulent flow inside an entrained system to make tiny droplets, as illustrated for example in prior art example 5 of FIG. 7E.

The entrained nebulizers still rely on the gas and liquid being emitted from a small orifice. They differ from concentric and cross flow nebulizers in that the liquid and gas are mixed first, and then ejected from a small tip. The pressure within the entrained area helps to force the liquid and gas out the small tip, and assists the break up of the liquid into smaller drops. Note that one of the non-pneumatic types of nebulization is simply to force the liquid itself out of a small orifice. If forced out fast enough through a small enough orifice, the liquid will break up into small drops even without a gas stream being associated with it. As with the concentric and cross flow nebulizer systems, entrained nebulizer systems have the exit passages narrow at the tip. This still allows small particles to easily block the exit passage.

4. Babington Nebulizers.

In the late 1960s, Robert S. Babington and associates developed another form of nebulizer (Canadian Patent # 854061, U.S. Pat. Nos. 3,421,692; 3,421,699; 3,425,058; 3,864,326, U.S. Pat. No. 3,421,692 is illustrated for example in prior art example 6 of FIG. 7F). In this method, the liquid is introduced onto a smooth, unconfining surface having a gas orifice in the surface. The liquid forms a film on the surface, due to surface tension, or due to shape of the surface. This stresses the film of liquid before it reaches the gas orifice. The film of liquid passes over the gas orifice, and is further stressed by the passage of the gas out of the orifice. This causes minuscule particles of the liquid, estimated to be approx. 50 microns in size, to break away from the film and forms a fog like spray.

The Babington system works on many shapes of surfaces. Babington proposed a spherical surface with the liquid delivered to the top of the sphere, and the gas orifice at the side. Later adaptations include U.S. Pat. No. 4,206,160 of Jun. 3, 1980, and U.S. Pat. No. 4,880,164, of Nov. 14, 1989, as illustrated for example in prior art example 7 of FIG. 7G. They use a 'V' shaped groove to direct the liquid towards the gas orifice, and use the sides of the 'V' groove to provide the smooth surface upon which the liquid forms a film.

The most immediate advantage of the Babington system is that the liquid passage is not restricted in any portion of the path. Small particles do not plug the liquid passage, and no cleaning is necessary to maintain the flow as a result. Also, the thin film formed on the surface is readily broken into tiny drops, and produces excellent nebulization with very simple apparatus.

The main disadvantages to the Babington type systems are the requirements that the liquid must flow over the gas orifice due to gravitational forces, and that many materials have poor wetting abilities, so that the film becomes difficult or impossible to form. The usage of gravity to deliver the liquid requires that the nebulizer must be correctly oriented, or the liquid film may flow away from the gas orifice and no nebulization will occur. Some materials such as Teflon, are essentially non-wetting, and the liquid does not readily form a film. In working on designs similar to patent U.S. Pat. No. 4,880,164 with Teflon as the material used for the body of the nebulizer, the liquid is often found to flow away from the 'V' groove. The non-wetting nature of the Teflon is stronger than the gravitational pull on the liquid.

It is apparent that all pneumatic nebulizers have the liquid broken into droplets by the induction action of a gas stream. The prior art nebulizers have various methods for delivering the liquid to the gas orifice, and some also use the suction at the gas orifice to draw the liquid up to the gas orifice. All have the above mentioned disadvantages, specifically being that they require specific orientations, or materials that are wettable, or have liquid passages that are narrowest at the orifices, leading to easy plugging.

There is only one essential requirement to produce atomization. This requirement is that the liquid must be brought close enough to the gas stream for the suction near the gas orifice to draw the liquid into the gas stream, and the liquid must be maintained at a level that does not cover the gas orifice. In a simple demonstration, one can provide a gas stream close to a body of water and the gas stream will atomize the water. For instance, as shown in FIG. 1, if a drinking cup of water is tilted so that the water is at the edge of the cup, and a gas stream is placed so that the gas orifice is just beside the water, the gas stream will draw the water to it, and produce a fine mist. FIGS. 2A–2C show the effects of the distance between the gas orifice and the liquid. If the gas orifice gets too close, the mist becomes a spray of water (FIG. 2C). If the gas orifice is too far away, the mist stops (FIG. 2A). Here the appropriate distance is on the order of 0.5 mm for a good mist (FIG. 2B).

In this simple example, several points are demonstrated: The water in the cup is a very large body of water compared to the gas orifice. The water arrived without any constraints on the path. There is no thin film required to decrease the surface tension as in the Babington method. The amount of liquid atomized is determined by the gas orifice size and pressure differential, not by the amount of liquid available. The liquid is drawn to the gas orifice by the suction at the orifice. As the liquid is atomized, the surface tension of the liquid will form a path to the gas orifice and maintain the flow of the water to the gas stream until there is a large change in the distance of the liquid from the gas orifice.

In applying this procedure to a device that can be manufactured, several methods may be used. The methods will work as long as the liquid surface can be maintained close enough to the gas orifice so that the surface tension of the liquid can maintain a path to the gas orifice. For instance, a stream of water of any diameter that is maintained in a smooth flow close to the gas orifice will act as an appropriate source to allow atomization of the liquid. The stream need not be constrained in a passage.

In normal usage of nebulizers, it is necessary to constrain the liquid in a passage to maximize the device's control of the process, and to minimize the liquid required to be delivered to the gas orifice. It is desirable for most applications that all of the liquid delivered to the gas orifice should be atomized. Many methods that allow the liquid to be maintained at an appropriate distance from the gas orifice, while enabling those skilled in the art to manufacture such a device with minimal effort will be apparent to those skilled in the art.

The method and apparatus of the present invention utilizes the surface tension of liquid, along with the natural induction caused by a gas stream out of an orifice to produce atomization of the liquid.

The nebulizer and method for dispersing liquids into a gas of the present invention provides improvements to the above-described problems in the conventional systems and methods and the nebulizer apparatus and method of the present invention form a new design category as will be explained later.

SUMMARY OF THE PRESENT INVENTION

Accordingly, it is an object of the invention to provide an improved method of dispersing liquids in a gaseous medium.

It is a further object to produce a more uniform liquid spray of very small liquid drops.

It is also an object of the present invention to produce this nebulization without the disadvantages of the prior art. In particular, this method allows for the usage of any material, regardless of its ability to wet, and to be able to work in any orientation, to have unrestricted flow in the liquid path which prevents plugging, and to prevent the alignment of the gas and liquid passages from being critical.

An additional object of the present invention is to provide a method that allows designs for such nebulizers to be able to be manufactured with minimal effort, and with minimal parts.

Other objects will be apparent to those skilled in the art, though not specifically set forth.

These and other objects may be accomplished by a method which utilizes the common feature of all pneumatic nebulizers in the induction of gas and liquids into a gas stream from an orifice, with the feature of a simple, though unique, method of delivering the liquid to the gas orifice.

The objects of the present invention are fulfilled by providing a process for atomizing liquids directly from a surface of a body of liquid at an interface between the liquid and an ambient gas or air comprising the steps of: providing a gas stream in close proximity to the liquid surface, the gas stream having a cross section that is substantially smaller than the body of the liquid, directing said gas stream away from the surface of the liquid so that the surface of the liquid is induced to extend directly to said gas stream without requiring formation of a film of the liquid on a surface of another material and being broken up into aerosol particles, and atomizing the liquid into a gaseous medium as a fine, highly consistent and uniform dispersion.

The objects of the present invention are also fulfilled by providing a nebulizer apparatus comprising a liquid passage for delivering a liquid to an exit area thereof, said liquid passage having a predetermined diameter equal to or smaller than a natural diameter of a free drop of said liquid so that said liquid stretches across said exit area by surface tension effects, and a gas passage for supplying a gas stream to a gas orifice thereof, said gas orifice placed in close proximity to said exit area so that induction effects of said gas orifice will include a surface of the liquid to extend directly to said gas stream without requiring formation of a film of the liquid on a surface of another material and draw said liquid into said gas stream to form a fine, highly consistent and uniformly dispersed mist.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
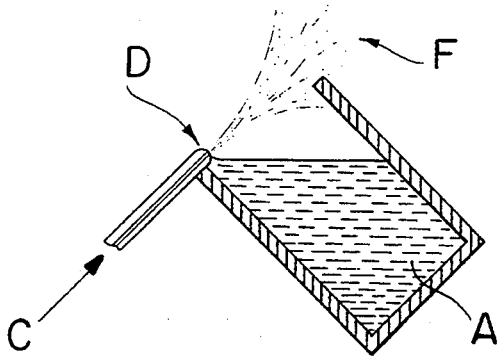
FIG. 1 shows the setup of a demonstration that atomization occurs by simply bringing a gas stream close to liquid.
Figure 2A:
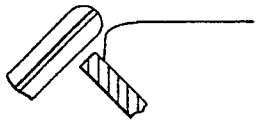
FIGS. 2A, 2B and 2C show a close up of the demonstration in FIG. 1, with the gas stream and liquid at several distances, for producing atomization at an appropriate distance.
Figure 2B:
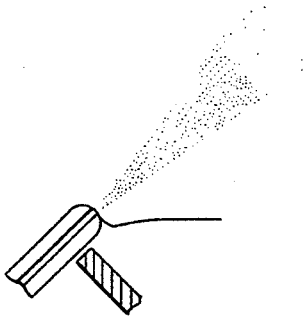
Figure 2C:
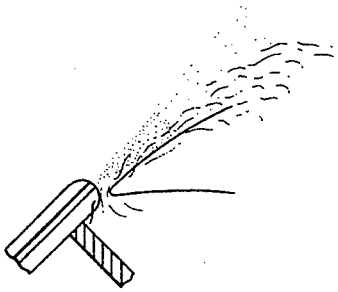
Figure 3:
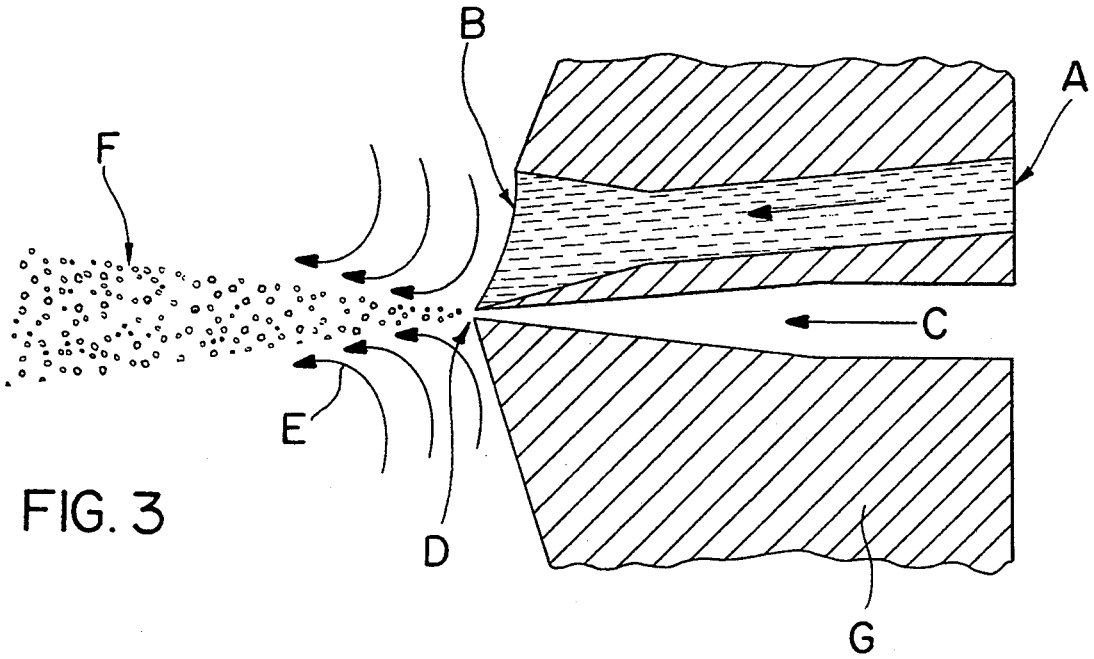
FIG. 3 shows a cross section of a nebulizing system used in a method for one embodiment of the present invention having the liquid passage and gas passage aligned with each other.
Figure 4:
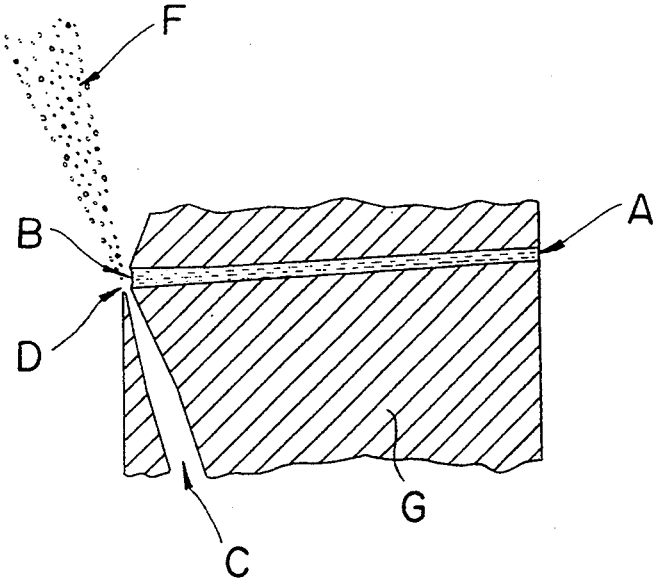
FIG. 4 shows a cross section of a nebulizing system used in a method for another embodiment of the present invention having an alternative arrangement of the gas and liquid passages.

FIG. 3 and FIG. 4 show cross sections of a nebulizer used in methods for embodiments of the present invention wherein the liquid may be delivered to the gas orifice D through a constrained liquid passage A. In these arrangements, it is desirable to produce a liquid passage A having an exit area B that is sufficiently small so that the surface tension of the liquid will support a liquid surface across the exit area B, and that the exit area B will maintain the liquid surface close enough to the gas orifice D to enable the liquid to be drawn into the gas stream E. It is advantageous to deliver the liquid to the exit area B at a rate lower than the gas stream can atomize, so that the liquid does not flow past the exit area B without being atomized. The difference in volume is very large between too little liquid delivered to the gas stream to produce a continuous mist and too much liquid delivered causing some liquid to not be atomized.

FIG. 3 shows that the liquid passage A in this method may be maintained at a constant first predetermined diameter throughout the nebulizer apparatus G, until a predetermined distance from the gas orifice D, at which point the liquid passage is either increased or decreased to a second predetermined diameter. The second predetermined diameter of the exit area B is the critical diameter and this diameter must be smaller than a diameter that the liquid's surface tension can support. To enable the nebulizer apparatus G to have a constant or increasing liquid path, the first predetermined diameter must also be less than the natural free drop diameter. However, the method will still function with the first predetermined diameter being greater than the natural free drop diameter as long as the second predetermined diameter of the exit area B remains less than the natural free drop diameter. This critical diameter can be easily determined by allowing a drop of the liquid to form in a slow controlled manner. For instance, one may fill an eye dropper with the liquid and carefully and slowly squeeze the dropper so that a drop begins to form at the tip. The drop will grow in diameter until the surface tension can no longer support the weight of the liquid drop, at which point the drop will fall off the eye dropper. If the diameter of the drop is measured just before it falls, that will give a good measure of the maximum diameter allowed in the liquid passage. For instance, water will form a drop of approx. 3.5 to 4 mm diameter in air. To maintain the liquid passage A less than the natural free drop size for water in air, the diameter of the liquid passage A should be less than 3.5 mm.

If the second predetermined diameter of the liquid passage exit area B is smaller than the liquid's natural free drop diameter, then the liquid's surface tension will cause the liquid to begin to form a drop when exiting from the exit area B. The drop will maintain itself intact and not drip until the drop has extended itself out from the liquid passage B. The gas stream E from the gas orifice D near the exit area B will draw the liquid into the gas stream E, and the liquid's surface tension will maintain contact between the gas orifice D and the exit area B.

The gas orifice D may be small compared to the liquid passage A, and the gas orifice D is situated at or near the edge of the exit area B. The gas orifice D may be just inside, on the edge, or just outside the liquid passage A. In all cases, the induction of the gas stream E is sufficient to draw the edge of the liquid into the gas stream E, and the surface tension of the liquid will cause the liquid to flow towards the gas orifice D. For non-wetting materials, a smaller, more consistent, droplet size is produced with the gas orifice D just inside or on the edge of the liquid passage exit area B.

The position of the gas orifice D is not critical. If the gas orifice D is inside the liquid passage B, the liquid is drawn to the gas orifice D, and induced into a fine spray, and none of the liquid passes the gas orifice D. So as the position of the gas orifice D moves in or out of the liquid passage exit area B, the only change occurring is the location of the commencement of the spray. The orientation of the gas passage C to the liquid passage A is also not critical. The orientation of the gas orifice D will effect the direction in which the final spray travels, but will not prevent the nebulization.

This method does not produce any suction on the liquid passage A, so the liquid must be delivered to the nebulizer apparatus G by some other conventional means, such as a pump or gravity feed (not shown). It is necessary that the gas flow be high enough so that all of the liquid delivered to the liquid passage exit area B can be induced into the gas stream. If the liquid is delivered faster than the gas stream can induce the liquid into a spray, then large drops of the liquid will pass out of the liquid passage A, producing an irregular spray. In normal operation, the gas flow will be far in excess of what is required to induce the liquid into the gas stream.

It is a feature of the present embodiment that most small particles in the liquid will be caught up in the induced spray. Those particles too big to be caught in the gas flow will be left beside the gas orifice D or in the liquid passage exit area B. Those particles can be easily washed away by continuing to pump the liquid while decreasing or stopping the gas flow.

Further, the method of the present embodiment allows the nebulizer apparatus G to operate in any orientation. There is no need for a gravitational force to direct the liquid.

FIG. 3 shows a detailed view of the gas orifice D and liquid passage exit area B with the liquid and gas paths in a near parallel orientation, with the liquid passage A widening at the exit. FIG. 4 shows an orientation for another embodiment of the present invention with the diameter of the liquid passage A remaining constant through the nebulizing apparatus G. It is desired for most devices to have the gas and liquid passages C and A closely aligned to minimize the size of the device, even though the gas and liquid passages may become out of alignment while maintaining the improved operating characteristics.

Figure 5:
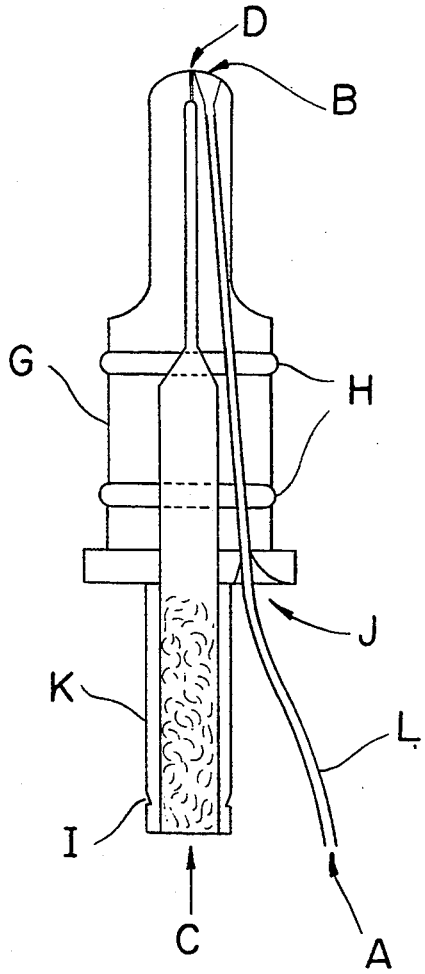
FIG. 5 shows a cross section side view of a nebulizer designed for analytical purposes for another embodiment of the present invention.
Figure 6A:
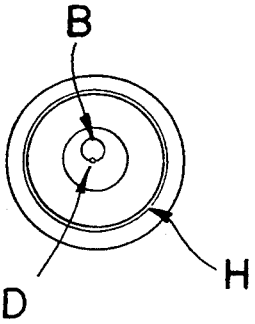
FIGS. 6A and 6B show top and side views of the nebulizer shown in FIG. 5.
Figure 6B:
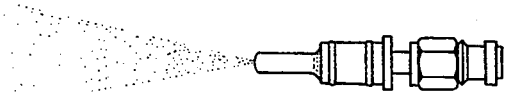
Figure 7A:
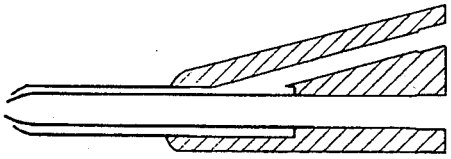
FIG. 7A PRIOR ART
FIGS. 7A, 7B, 7C, 7D, 7E, 7F and 7G show prior art nebulizers.
Figure 7B:
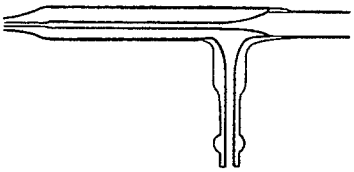
PRIOR ART FIG. 7B
Figure 7C:
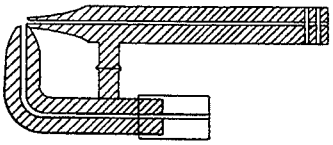
PRIOR ART FIG. 7C
Figure 7D:
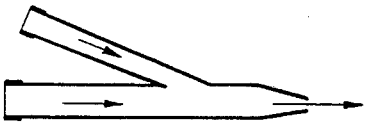
PRIOR ART FIG. 7D
Figure 7E:
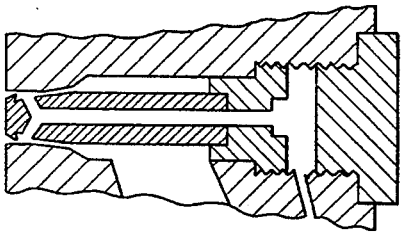
PRIOR ART FIG. 7E
Figure 7F:
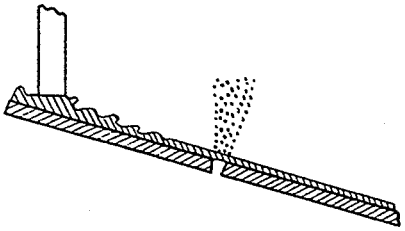
PRIOR ART FIG. 7F
Figure 7G:
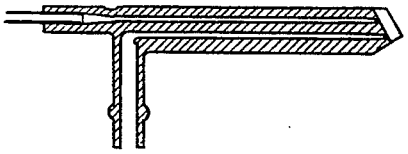
PRIOR ART FIG. 7G

FIG. 5 and FIGS. 6A and 6B show an embodiment of the present invention for a method of producing a nebulizer suitable for analytical requirements. The method is not limited to this usage, but this is a good example of the features for the present embodiment.

In this example, the body of the nebulizer G is constructed of Teflon, and can be machined out of a single piece of material. However, the body of the nebulizer G is not limited to Teflon and any other material may be used for the nebulizer G such as glass, plastic or metal. Few other designs of nebulizers can be machined out of a single piece, other than some Babington type designs. Babington type nebulizers do not work well if made of Teflon, since Teflon is essentially non-wetting. The standard "V" groove Babington Teflon nebulizers have difficulty getting the liquid to run in the groove, and the liquid does not form a good film over the Teflon surface. For analytical usage, Teflon is preferred to other materials since it is inert to acids and solvents. Glass, which is in common usage for Babington type systems, will dissolve in HF acid.

The gas inlet for the gas passage C may be designed to fit any tube fitting, for example, a standard $\frac{1}{4}$ inch (6.35 mm) swagelock tube fitting. Notches I on the end of the gas inlet help hold a compression ring M, such as a swagelock compression ring for example, in place. A liquid passage entrance notch J allows for easy insertion of a capillary tubing L, and minimizes bending of the capillary tubing L. Liquid is delivered in the capillary tubing L (made of material such as Polyethylene or Teflon, for example). The capillary tubing L is held in place inside the liquid passage A by tension. The capillary tubing L is stretched for a small distance (the first few cm), to allow the capillary tubing L to be pulled into the liquid passage A, then the stretched portion is cut off, and the non-stretched portion is pulled back into the liquid passage A. With the liquid delivered by means of a constant diameter tubing from the liquid supply device to the inside of the liquid passage A, the smallest diameter in the path is the capillary tubing L, and any plugging due to small particles in the liquid will occur at the joint between the capillary tubing L and the liquid supply device, and not in the nebulizer G. Such plugging can be easily cleared by cutting off the first 1 mm of the capillary tubing L, and reattaching the capillary tubing L to the liquid supply device.

The liquid arrives at the liquid passage exit area B and fills the passage due to surface tension. For example, the exit does not exceed 2.5 mm in diameter. The gas orifice D is preferably in line with the body of the nebulizer G, and is for example approximately 0.01 mm in diameter. This size of the gas orifice D allows the usage of gas pressures in the order of 40 to 140 psi (approx. 250 to 1000K Pascals). Other gas pressures can be used by adjusting the gas orifice diameter to match. Higher gas pressures cream more flow, better shearing action on the liquid, and a smaller droplet size in the final mist.

It is difficult to aim the drilling bits accurately when producing the gas orifice D. In this example, the liquid passage exit area B is widened after production of the gas orifice D. This allows the final adjustment for the position of the gas orifice D and liquid passage exit area B to be accurately done with normal machining tools. The exit area B is simply widened until it touches or just passes the gas orifice D. To prevent the gas orifice D from being plugged by small particles in the gas, a filter K may be placed at the beginning of the gas passage C.

In operation, the gas stream E from the gas orifice D induces the surrounding lower pressure gas into the gas stream E, and creams a suction in the near vicinity of the gas orifice D towards the gas stream E out of the gas orifice D. The liquid arriving at the liquid passage exit area B is drawn towards the gas orifice D by this suction, and upon arriving at the gas orifice D, the liquid is also induced into the gas stream E, and is broken into small droplets F as illustrated in FIGS. 3 and 4 for example. The quality of the atomization produced can be adjusted by varying the size of the gas orifice D and gas pressure. Higher gas pressures create smaller liquid drops in the gas stream E. The volume of gas is not the main determining factor for the liquid drop size, when the volume of gas is sufficient to induce all of the liquid into the gas stream E. The diameter of the gas orifice D is adjusted to control the volume of gas being emitted. The speed of the gas jet is determined by the gas pressure differential between the gas in the nebulizer G and the gas in the area outside the nebulizer G. The speed of the emitted gas stream E is a major determining factor in the liquid drop size.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for atomizing liquids directly from a surface of a body of liquid at an interface between the liquid and an ambient gas or air, comprising the steps of:

providing a gas stream having a cross section that is substantially smaller than the body of the liquid;

directing said gas stream away from the surface of the liquid in close proximity to the surface of the liquid so that the surface of the liquid is induced to extend directly to said gas stream without requiring formation of a film of the liquid on a surface of another material and being broken up into aerosol particles; and atomizing the liquid into a gaseous medium as a fine, highly consistent and uniform dispersion.

2. A process as claimed in claim 1, wherein the liquid is delivered by liquid supply means to a close proximity of said gas stream through a passage having a predetermined diameter equal to or smaller than a natural diameter of a free drop of the liquid so that the liquid stretches across an exit area of said passage by surface tension effects for providing the surface of the body of the liquid with the interface between the liquid and the ambient gas or air and inducing the liquid from the surface of the liquid at said exit area into the gas stream to form a fine aerosol mist.

3. A process as claimed in claim 2, wherein said predetermined diameter of said passage is constant throughout said passage.

4. A process as claimed in claim 2, wherein said predetermined diameter of said passage is constant throughout a first portion of said passage and said predetermined diameter increases for a second portion of said passage extending to said exit area with said predetermined diameter remaining less than the natural diameter of the free drop of the liquid.

5. A process as claimed in claim 2, wherein said gas orifice is on an edge of said exit area.

6. A process as claimed in claim 2, wherein a gas orifice is near an edge of said exit area.

7. A process as claimed in claim 2, wherein a diameter of said gas orifice is much smaller than said predetermined diameter of said passage.

8. A process as claimed in claim 2, wherein said passage and said gas orifice connected to a gas passage are contained in a nebulizer body.

9. A process as claimed in claim 8, wherein said nebulizer body is formed of Teflon, plastic, metal or glass.

10. A process as claimed in claim 2, wherein said liquid supply means comprises a pump.

11. A process as claimed in claim 2, wherein said liquid supply means comprises a gravity feed.

12. A nebulizer apparatus comprising:

a liquid passage for delivering a liquid to an exit area thereof, said liquid passage having a predetermined diameter equal to or smaller than a natural diameter of a free drop of said liquid so that said liquid stretches across said exit area by surface tension effects; and a gas passage for supplying a gas stream to a gas orifice thereof, said gas orifice placed in close proximity to said exit area so that induction effects of said gas orifice will induce a surface of the liquid to extend directly to said gas stream without requiring formation of a film of the liquid on a surface of another material, and draw said liquid into said gas stream to form a fine, highly consistent and uniformly dispersed mist.

13. A nebulizer apparatus as claimed in claim 12, wherein said predetermined diameter of said liquid passage is constant throughout said liquid passage.

14. A nebulizer apparatus as claimed in claim 12, wherein said predetermined diameter of said liquid passage is constant throughout a first portion of said liquid passage and said predetermined diameter increases for a second passage of said liquid portion extending to said exit area with said predetermined diameter remaining less than a natural diameter of a free drop of said liquid.

15. A nebulizer apparatus as claimed in claim 12, wherein said gas orifice is placed on an edge of said exit area.

16. A nebulizer apparatus as claimed in claim 12, wherein said gas orifice is placed near an edge of said exit area.

17. A nebulizer apparatus as claimed in claim 12, wherein a diameter of said gas orifice is much smaller than said predetermined diameter of said liquid passage.

18. A nebulizer apparatus as claimed in claim 12, further comprising a nebulizer body including said liquid passage and said gas passage.

19. A nebulizer apparatus as claimed in claim 18, wherein said nebulizer body comprises Teflon, plastic, metal or glass.

20. A nebulizer apparatus as claimed in claim 12, wherein said liquid supply means comprises a pump or a gravity feed.

* * * * *